US009212457B2

(12) United States Patent
Wagner et al.

(10) Patent No.: US 9,212,457 B2
(45) Date of Patent: Dec. 15, 2015

(54) HEIGHT ADJUSTMENT DEVICE FOR A SCREED PLATE OF A ROAD FINISHER AND ROAD FINISHER WITH SUCH A HEIGHT ADJUSTMENT DEVICE

(71) Applicant: BOMAG GmbH, Boppard (DE)

(72) Inventors: Jens Wagner, Boppard (DE); Filippo Casadio, Cotignola RA (IT)

(73) Assignee: BOMAG GmbH, Boppard (DE)

( * ) Notice: Subject to any disclaimer, the term of this patent is extended or adjusted under 35 U.S.C. 154(b) by 57 days.

(21) Appl. No.: 14/163,264

(22) Filed: Jan. 24, 2014

(65) Prior Publication Data

US 2014/0212217 A1 Jul. 31, 2014

(30) Foreign Application Priority Data

Jan. 28, 2013 (DE) ..... 10 2013 001 404
Apr. 23, 2013 (DE) ..... 10 2013 007 061

(51) Int. Cl.
*E01C 19/42* (2006.01)
*E01C 19/48* (2006.01)

(52) U.S. Cl.
CPC ..... *E01C 19/42* (2013.01); *E01C 19/4866* (2013.01); *E01C 2301/16* (2013.01)

(58) Field of Classification Search
CPC ... E01C 19/40; E01C 19/4853; E01C 19/187; E01C 23/06; E01C 19/42; E01C 19/4866
See application file for complete search history.

(56) References Cited

U.S. PATENT DOCUMENTS 4,272,213 A * 6/1981 McGovarin ..... 404/118
4,345,852 A 8/1982 Goto et al.
4,493,585 A * 1/1985 Axer ..... 404/102
4,507,014 A * 3/1985 Heims et al. ..... 404/102
4,682,908 A * 7/1987 Domenighetti ..... 404/84.1
5,213,442 A * 5/1993 Sovik ..... 404/102
5,423,628 A * 6/1995 Jaworski ..... 404/114
6,341,542 B1 * 1/2002 Ade et al. ..... 81/57.37
2002/0187004 A1 * 12/2002 Casters ..... 404/96

FOREIGN PATENT DOCUMENTS

DE 27 09 435 A1 9/1978
DE 30 12 695 A1 11/1980
DE 92 11 854 U1 2/1994
DE 295 05 382 U1 7/1995
GB 1 560 469 A 2/1980

OTHER PUBLICATIONS

Espacenet, English Machine Translation of German Application No. DE9211854U1, retrieved on Jan. 20, 2014 from http://worldwide.espacenet.com, published Feb. 24, 1994 (9 pages).

* cited by examiner

*Primary Examiner* — Abigail A Risic
(74) *Attorney, Agent, or Firm* — Wood, Herron & Evans, LLP

(57) ABSTRACT

There are described a height adjusting device for an extendable screed plate for a road finisher and a road finisher comprising such a device. A ground element of the extendable screed plate is disposed with two pairs of worm gears on a top part of the extendable screed plate for vertical displacement thereon, wherein the worm gears of each pair are interconnected by a power transmission for concomitant actuation. Each pair is provided with a releasable clutch, preferably a conical clutch, by means of which the connection between an adjusting member of a pair and the associated transmission gear can be broken.

10 Claims, 4 Drawing Sheets

HEIGHT ADJUSTMENT DEVICE FOR A SCREED PLATE OF A ROAD FINISHER AND ROAD FINISHER WITH SUCH A HEIGHT ADJUSTMENT DEVICE

CROSS-REFERENCE TO RELATED APPLICATIONS

The present application claims priority under 35 U.S.C. §119 of German Patent Application Nos. 10 2013 001 404.2, filed Jan. 28, 2013 and 10 2013 007 061.9, filed Apr. 23, 2013, the disclosures of which are hereby incorporated herein by reference in their entireties.

FIELD OF THE INVENTION

The present invention relates to a height adjusting device for an extendable screed plate of a road finisher, which can also be referred to as a pavement finisher, wherein a ground element of the extendable screed plate having two pairs of adjusting members is disposed for vertical adjustment on a top part of the extendable screed plate, wherein the adjusting members on each pair are interconnected via an actuator for concomitant actuation thereof, which adjusting members are configured as worm gears. The present invention further relates to a road finisher comprising such a height adjusting device.

BACKGROUND OF THE INVENTION

A road finisher comprising a height adjusting device of this type is disclosed in DE 29505382 U1. It comprises a basic screed plate and two extendable screed plates that can be hydraulically extended parallel to the basic screed plate for the purpose of broadening the work area. The basic screed plate and the extendable screed plates comprise ground elements, of which each is provided with a base plate on its underside. The extendable screed plates are mounted on the basic screed plate for vertical adjustment thereon, so that their base plates can be adjusted and moved to a specified position relative to the base plates of the basic screed plate. To this end, each ground element of the extendable screed plates is provided with two pairs of adjusting members on the main screed plate, these being located in the region of the two end faces of each extendable screed plate. The adjusting members are in the form of screws or screw-threaded spindles disposed at one end on the ground element and at the other end on, in each case, a leg of a toggle joint. The other two legs of the toggle joint of a pair are further interconnected via a linkage system such that both toggle joints can be actuated concurrently for the purpose of altering the height of the relevant side of the ground element relatively to the basic screed plate.

A drawback of this arrangement may be considered to be the fact that the toggle joint and the linkage system are required to absorb the weight of the respective ground element. They, therefore, have to be appropriately bulky and are, therefore, relatively expensive.

In order to alter the thickness of the layer of material being filled in and for adaptation to the consistency thereof, it is important that it be also possible to change the setting angle of the ground element. The setting angle, which may also be referred to as the adjusted angle, is the angle between the base plate and the ground as regarded in the direction of travel. A regulating device for the setting angle is disclosed in DE 9211854 U1. An adjustment of the setting angle accordingly takes place in that that adjusting member of a pair which is adjacent to the basic screed plate is displaced, while the other adjusting member of said pair remains unchanged.

It is an object of the present invention to provide a height adjusting device and a road finisher of the kind defined above, in which the actuator used is inexpensive and which makes it possible to adjust the setting angle in a simple manner.

SUMMARY OF THE INVENTION

According to one embodiment of the present invention, the worm gears of a pair are interconnected for the purpose of transferring rotary movement via a transmission gear, and a worm gear of a pair is connected to the actuator. The transmission gear acts on the worm gears of a pair and causes them to turn. They are, therefore, used not only for the purpose of carrying out adjustments during the initial operation phase and maintenance of the ground element, but also for vertical adjustments under working conditions of the extendable screed plate when its relative position to the basic screed plate is shifted. The load of the ground elements is borne exclusively by the worm gears. No additional components are necessary for bearing loads, since no loads are placed on the actuator. Thus, these need only be sufficiently dimensioned such that they can transfer the torques necessary for turning the worm gears.

When the worm gear is in the form of a screw-threaded spindle and spindle nut, it is basically possible to interconnect the screws of the worm gear via the transmission gear. According to one embodiment of the present invention, the transmission gear non-rotatably connects the spindle nuts of a pair.

This has the advantage that the spindle nuts can be designed relatively simply as part of the transmission gear, for example, they can be in the form of belt pulleys and gearwheels.

A very simple embodiment of the transmission gear is provided when the transmission gear is in the form of a power transmission, and the spindle nuts of a pair are the shafts of the respective power transmission.

It is advantageous to configure the power transmission as a chain drive comprising two gearwheels, and to dispose the gear wheels on the spindle nuts of a pair. In this way, a positive transmission is achieved even at high torques, as is necessary for exact height adjustment.

Simple adjustment of the setting angle is achieved, according to the present invention, in that each pair is provided with a releasable clutch, by means of which the connection between an adjusting member of a pair and the associated transmission gear can be broken.

This has the advantage that the setting angle of one worm gear of a pair can be readjusted irrespective of the other worm gear of the pair, such that it can be set in a specific relationship to the other worm gear. By the "setting angle" is meant the angle between a base plate of the paving screed plate and the surface being treated, in this case the ground. Such a readjustment may be necessary, for example, when the power transmission has play and thus the setting angles for the basic screed plate and the extendable screed plate cannot be exactly set to the same value, as is basically to be desired. Readjustment may also be necessary, however, when it is deliberately desirable to set different setting angles for the basic screed plate and the main screed plate.

It is advantageous to configure the clutch as a force-locked, more particularly, a friction-locked, clutch, since in such a case the two clutch parts will engage in any desired angular position. This ensures that when the clutch is engaged, one worm gear will not become angularly offset from the other worm gear, as could be the case with a form-locked clutch in which the two clutch parts would have to be aligned to each other.

A particularly advantageous embodiment of the clutch is achieved when the clutch is formed as a conical clutch between a spindle nut and the corresponding coaxial portion of the transmission gear directly connected to the spindle nut. In the case of a chain drive, the conical clutch is formed between the spindle nut and the associated gearwheel.

The advantage of a conical clutch resides in the fact that it is on the one hand easy to engage and disengage.

It has proven to be particularly advantageous when the conical clutch consists of a downwardly tapered truncated cone on the spindle nut and a corresponding bushing in a hub of the associated gearwheel and also a counter-nut on the spindle nut, on which the hub is mounted for axial displacement.

In order to facilitate access for an operator, the actuator is disposed on that worm gear of a pair which is on that side of the extendable screed plate that is remote from the basic screed plate.

To ensure that the ground element can readily adapt itself in the longitudinal and transverse directions to different angles of inclination, it is advantageous for the worm gears to be disposed with ball-and-socket joints on the top part and on the ground element of the extendable screed plate.

BRIEF DESCRIPTION OF THE DRAWINGS

The present invention is explained in greater detail below with reference to an exemplary embodiment illustrated in the drawings, in which.

DETAILED DESCRIPTION OF THE INVENTION

Figure 1:
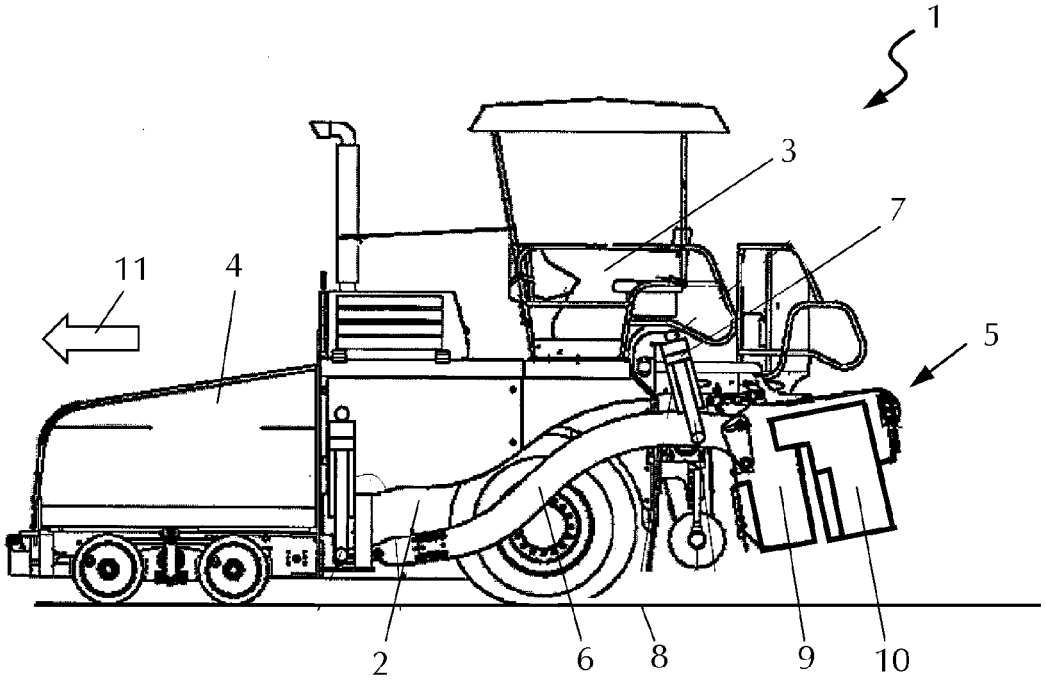
FIG. 1 is a diagrammatic side view of a road finisher.

According to FIG. 1, a road finisher 1 comprises a chassis 2 and a driver's platform 3. The forward direction is designated by the arrow 11. At the front of the road finisher 1 there is provided a tub 4 for the purpose of accommodating a blend to be paved. At the rear there is situated a paving screed plate 5, which is hingedly attached to the chassis 2 via tension arms 6. The paving screed plate 5 can be raised, lowered and held in an arbitrary vertical position with the assistance of double acting actuation cylinders 7. In the neutral position illustrated, the paving screed plate 5 is raised from the ground 8. In a working position, the paving screed plate 5 floats on the ground 8. The paving screed plate 5 spreads the blend with an adjusted thickness over the ground 8 and compresses and smoothes it. The paving screed plate 5 consists of a basic screed plate 9 and two extendable screed plates 10, of which the side view illustrated in FIG. 1 shows only one extendable screed plate.

Figure 2:
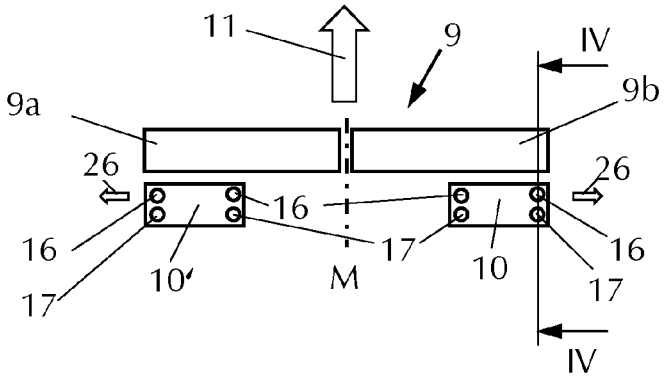
FIG. 2 is a diagrammatic top view of a paving screed plate comprising retracted extendable screed plates.
Figure 3:
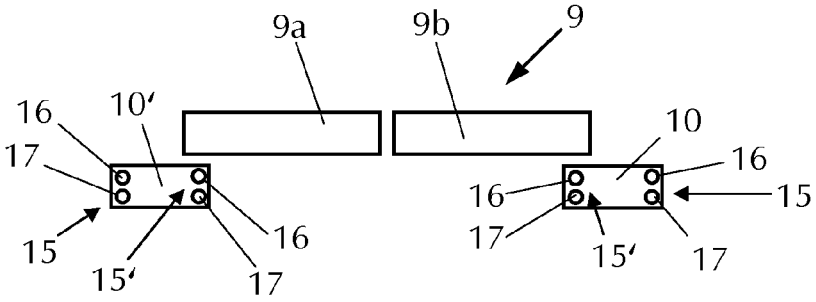
FIG. 3 is a diagrammatic top view of the paving screed plate showing extended extendable screed plates.

According to FIGS. 2 and 3, the basic screed plate 9 is divided lengthwise into screed plate halves 9*a*, 9*b*, which can be inclined at an angle to each other to form a roof-shaped profile. On each screed plate half 9*a*, 9*b* there is further disposed an extendable screed plate 10, 10' that is located behind the basic screed plate 9, as regarded in the forward direction of travel 11 and that is reciprocally retractable in a direction parallel to the basic screed plate 9. The two screed plate halves 9*a*, 9*b* and associated extendable screed plates 10, 10' differ from each other only in that they are of mirror-inverted design about a center line M of the basic screed plate 9. Thus, the following description applies equally to both screed plate halves 9*a*, 9*b* and both extendable screed plates 10, 10', although reference may be made to only one of the screed plate halves 9*a* and the associated extendable screed plate 10.

The extendable screed plates 10, 10' serve to broaden the base width of the paving screed plate 5. FIG. 2 shows them in a retracted state, in which they do not extend beyond the outermost faces of the two screed plate halves 9*a*, 9*b*. For the purpose of broadening the base width, each is mounted for longitudinal movement via one of a pair of parallel telescopic guide cylinders 12 along the screed plate halves 9*a*, 9*b*. They can be moved by hydraulic power beyond the outer faces of the two screed plate halves 9*a*, 9*b* as shown by arrows 26, independently by a freely selectable distance. According to the illustration shown in FIG. 3, both extendable screed plates 10, 10' have been moved outwardly beyond the two screed plate halves 9*a*, 9*b* of the basic screed plate 9.

The extendable screed plates 10, 10' comprise in their four corner regions in each case a vertically acting adjusting member 16, 17, by means of which the height of a ground element 14 on each extendable screed plate 10, 10' (FIG. 4) can be adjusted and moved in relation to the basic screed plate 9. The two adjusting members 16, 17 at the end faces of the extendable screed plates 10, 10' are in each case coupled as a pair 15, 15' such that they can be actuated both together in pairs or that only one of the two adjusting members 16, 17 of a pair 15, 15' can be adjusted. The vertical adjustment of the ground element 14 takes place in relation to the basic screed plate 9, i.e., the position of the basic screed plate 9 represents the reference value for the height of the ground element 14.

When both pairs 15, 15' of a ground element 14 are adjusted to the same extent, the ground element 14 is moved to a height at which it is parallel to the basic screed plate 9. In the illustration shown in FIGS. 2 and 3, there is accordingly displacement thereof parallel to the projection plane. If only one pair 15 is vertically adjusted while the other pair 15' remains unchanged or if both pairs 15, 15' are vertically adjusted by different amounts, the ground element 14 is set lengthwise at an angle to the basic screed plate 9. In this way, a so-called roof-shaped profile or a V-profile of the basic screed plate 9 and the extendable screed plate 10 can be produced, for example, in the longitudinal direction of the basic screed plate 9 and the extendable screed plate 10.

Figure 4:
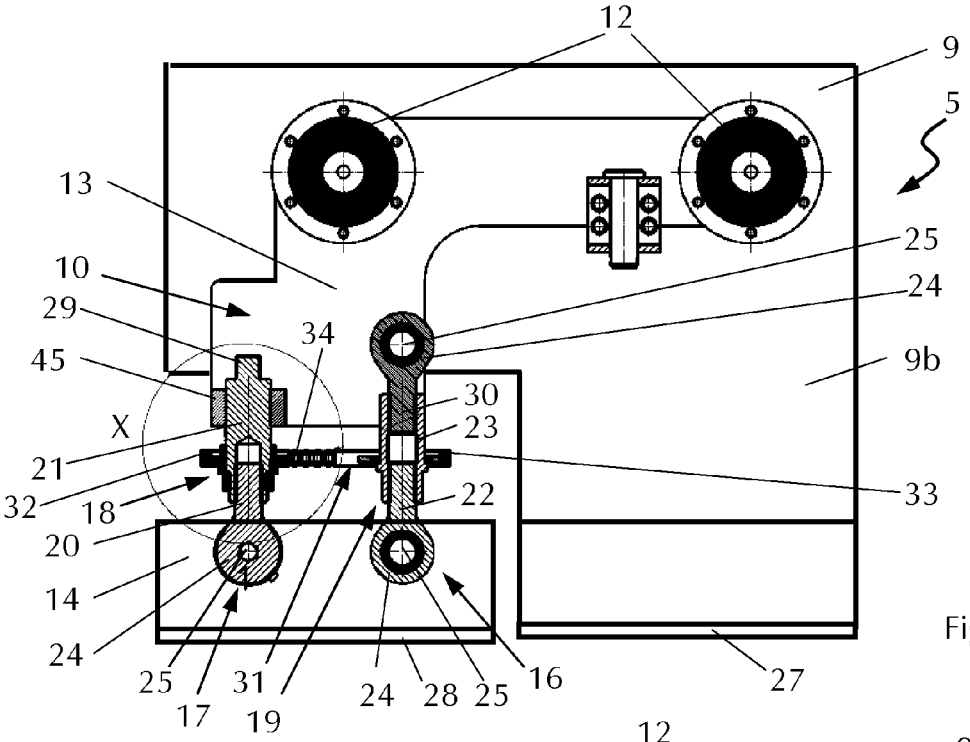
FIG. 4 shows a cross-section through a paving screed plate taken along the line IV-IV in FIG. 2 showing a basic screed plate and an extendable screed plate in a basic position.

As shown in FIG. 4, each extendable screed plate 10 comprises a top part 13 and a ground element 14 disposed thereunder. The top part 13 of the extendable screed plate 10 is bearing-mounted for displacement by horizontal telescopic guide cylinders 12 displaceable along the basic screed plate 9. The top part undergoes no change in height in relation to the basic screed plate 9. The ground element 14 is bearing-mounted in its four corner regions on the top part 13 via the two pairs 15, 15' of adjusting members 16, 17.

The basic screed plate 9 and the extendable screed plate 10 each comprise a base plate 27 or 28 respectively on their undersides, as shown in FIG. 4. The base plate 28 of the extendable screed plate 10 is disposed on the ground element 14. The base plates 27, 28 are also referred to as screed plate.

In a neutral position of the ground element 14 and the basic screed plate 9, as shown in FIG. 4, the ground element 14 and the basic screed plate 9 are at the same height. The two base plates 27, 28 of the ground element 14 and the basic screed plate 9 are in alignment with each other.

As further shown in FIG. 4, the adjusting members 16, 17 of a pair 15 are in the form of a first worm gear 18 and a second worm gear 19. The first worm gear 18 comprises a first vertically oriented screw-threaded spindle 20 and a first spindle nut 21. The second worm gear 19 is provided with a vertically oriented second screw-threaded spindle 22 and a second spindle nut 23. The first spindle nut 21 is mounted via a pivot bearing 45 for rotation on the top part 13 of the extendable screed plate 10, so that it can be rotated for actuation of the first worm gear 18. It comprises at its upper free end a connecting piece 29 for a drive (not shown). It can be subjected to the action of a drive motor or be in the form of a hexagon head configured to accommodate a ratchet key.

Figure 6:
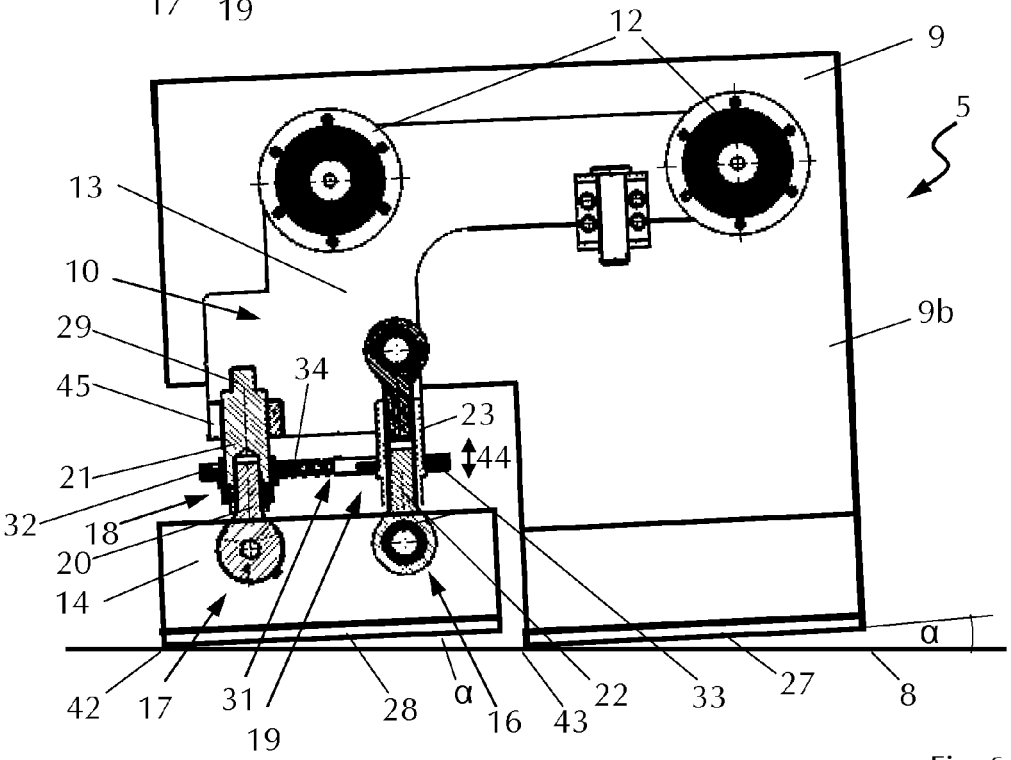
FIG. 6 is a cross-section through the paving screed plate shown in FIG. 2 showing a first adjustment of the setting angle of the basic screed plate and the extendable screed plate.

The first screw-threaded spindle 20 is provided at its lower end with a bearing eye 24, of which the center axis is directed parallel to the longitudinal direction of the ground element 14. The bearing eye 24 accommodates a ball-and-socket joint 25, by means of which the ground element 14 is held against the first screw-threaded spindle 20. The ball-and-socket joint 25 is formed such that the first screw-threaded spindle is non-rotatably fixed to the ground element 14, and that the ground element 14 can be inclined in the longitudinal direction and in the transverse direction of the ground element 14. The longitudinal inclination is formed with the adjustment to a roof-like or V-shaped profile. The transverse inclination serves to adjust a setting angle $\alpha$ or $\beta$ (FIG. 6, 7). The upper end of the first screw-threaded spindle 20 is rotatably mounted in the first spindle nut 21. A detailed view X of the first worm gear 18 is illustrated in FIG. 5.

The second screw-threaded spindle 22 is, like the first screw-threaded spindle 20, provided at its lower end with a bearing eye 24 for the accommodation of a ball-and-socket joint 25. The second spindle nut 23 is rotatably mounted on a pivot 30, which is suspended on the top part 13 via a bearing eye 24 and a ball-and-socket joint 25. The rotary connection between the pivot 30 and the second spindle nut 23 is, unlike the connection between the second spindle nut 23 and the second screw-threaded spindle 22, purely rotational, i.e., when it is rotated, it causes no translational motion and no change in length of the second worm gear 19.

The first spindle nut 21 and the second spindle nut 23 of a pair 15, 15' are non-rotatably interconnected via a power transmission 31. The power transmission 31 consists of two twin gearwheels 32, 33 and a chain-link 34. The second gearwheel 33 is non-rotatably mounted on the second spindle nut 23. The first gearwheel 32 is connected to the first spindle nut 21 via a clutch 35 (FIG. 5). By this means the gear wheels 32, 33 rotate with the associated spindle nuts 21, 23, and thus form, so-to-say, the shafts of the power transmission 31.

Figure 5:
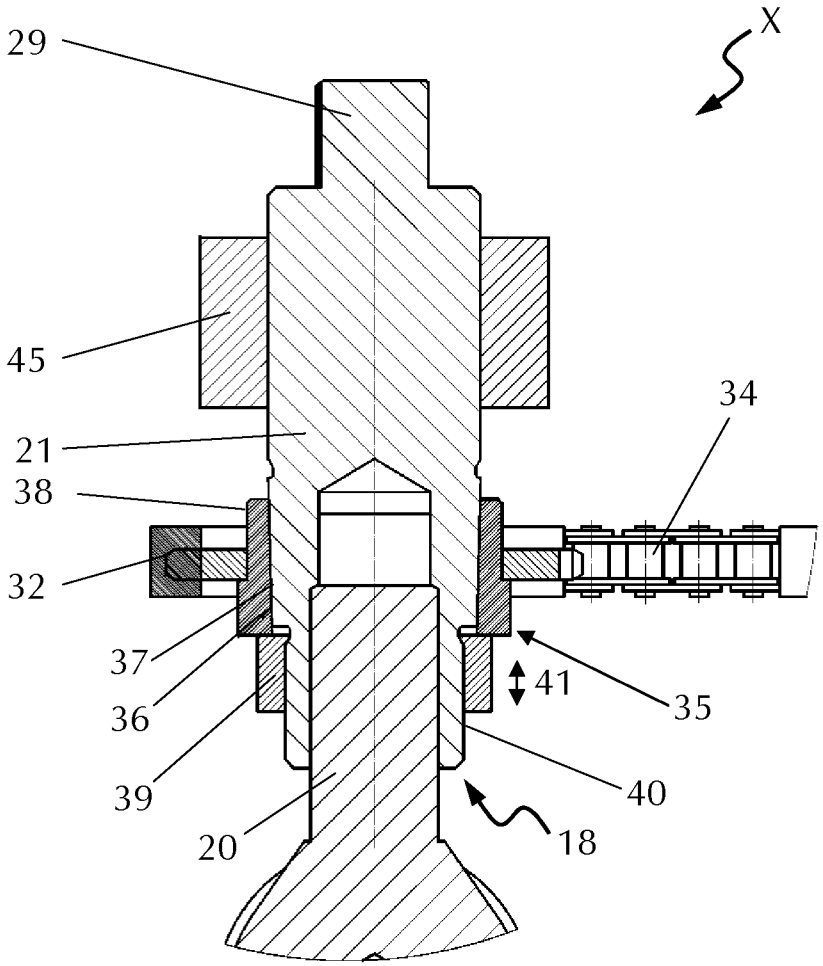
FIG. 5 is a detailed view of an adjusting member.

As FIG. 5 shows, the clutch 35 is in the form of a conical clutch. A portion of the outside wall of the first spindle nut 21 is in the form of a truncated cone 36, which tapers downwardly in the direction of the first plate 28. The counterpart of the truncated cone 36 is in the form of a conical bushing 37 in the hub 38 of the first gearwheel 32. The hub 38 can, therefore, also be referred to as a clamping hub with an internal cone. The hub 38 is mounted on the first spindle nut 21 for axial displacement thereon. The hub 38 is with its bushing 37 axially displaceable on the first spindle nut 21 on account of a counter-nut 39. In this way, the bushing 37 can, by turning the counter-nut 39, be pushed onto the truncated cone 36 or withdrawn from the truncated cone 36. The counter-nut 39 is mounted on a male thread 40 on the first spindle nut 21 below the hub 38. By turning the counter-nut 39, it is possible to change its axial position on the first spindle nut 21, as indicated by the double-headed arrow 41. Axial motion of the counter-nut 39 causes a movement of the hub 38 following the movement of the counter-nut 39.

When the counter-nut 39 is turned for meshing purposes, the counter-nut 39 exerts an axial pressure on the hub 38 and pushes in this way the first gearwheel 32 upwardly until the hub 38 is non-rotatably mounted on the truncated cone 36. When the counter-nut 39 is rotated in the other direction for the purpose of decoupling, the first gearwheel 32 moves downwardly by reason of its weight and thus releases the connection between the hub 38 and the truncated cone 36.

By screwing the counter-nut 39 in one direction (upwardly), the truncated cone 36 and the bushing 37 are pulled into each other and non-rotatably blocked. If the counter-nut 39 is screwed in the other direction (downwardly), the bushing 37 is released from the truncated cone 36. The truncated cone 36 and the bushing 37 become disengaged and the non-rotational connection between the two is cancelled.

When the clutch 35 is engaged, the two spindle-nuts 21, 23 are together turned through the same rotary angle. In this way, the two adjusting members 16, 17 of a pair 15, 15' can be synchronously vertically adjusted.

According to FIG. 6, the basic screed plate 9, that is, the second base plate 27 of the screed plate halves 9*a* is inclined at a first setting angle a to the ground 8. The top part 13 of the extendable screed plate 10 is, together with the telescopic guide cylinders 12, inclined by the same amount and the degree of inclination is transferred via the adjusting members 16, 17 to the ground element 14 and the first base plate 28. The first base plate 28 is, therefore, likewise inclined at the first setting angle a. If the two base plates 27, 28 were to remain flush with each other on inclination of the basic screed plate 9, the backward edge 42 of the first base plate 28 would move to a lower position than the backward edge 43 of the second base plate 27, which would lead to unwanted long steps in the spread layer. The backward edges 42, 43 of the two base plates 27, 28 must, therefore, be oriented at the same height. To this end, the level of the ground element 14 together with the first base plate 28 must be upwardly offset, as indicated by the double-headed arrow 44, while retaining the first setting angle $\alpha$. The aligned final position is illustrated in FIG. 6.

The vertical adjustment takes place by turning the first spindle nut 21 by means of the connecting piece 29 and with the clutch 35 engaged. During this procedure, the counter-nut 39 is screwed against the hub 38 of the first gearwheel 32, so that the hub 38 and the first spindle nut are locked. By this means, the rotation of the first spindle nut 21 is transferred to the first gearwheel 32 and, via the chain-link 34, the second gearwheel 33 is entrained through the same rotary angle. With the second gearwheel 33, the second spindle nut 23 is also rotated. In this way, the two adjusting members 16, 17 are shortened by the same amount and the first base plate 28 is vertically adjusted parallel to its basic position.

The case may arise that on account of play, wear or the like, the rotation of the first spindle nut 21 will not be transferred to the second spindle nut 23 under exactly the same adjusting angle. The first base plate 28 will not then assume the same setting angle a as the second base plate 27. The setting angle of the first base plate 28 must thus then be corrected.

For this purpose, the clutch 35 is decoupled, so that any rotation of the first spindle nut 21 will not be transferred to the second spindle nut 23. Thus, rotation of the first spindle nut 21 causes only a change in length of the first adjusting member 17. This adjustment continues until the first base plate 28 has the same setting angle α as the second base plate 27.

Figure 7:
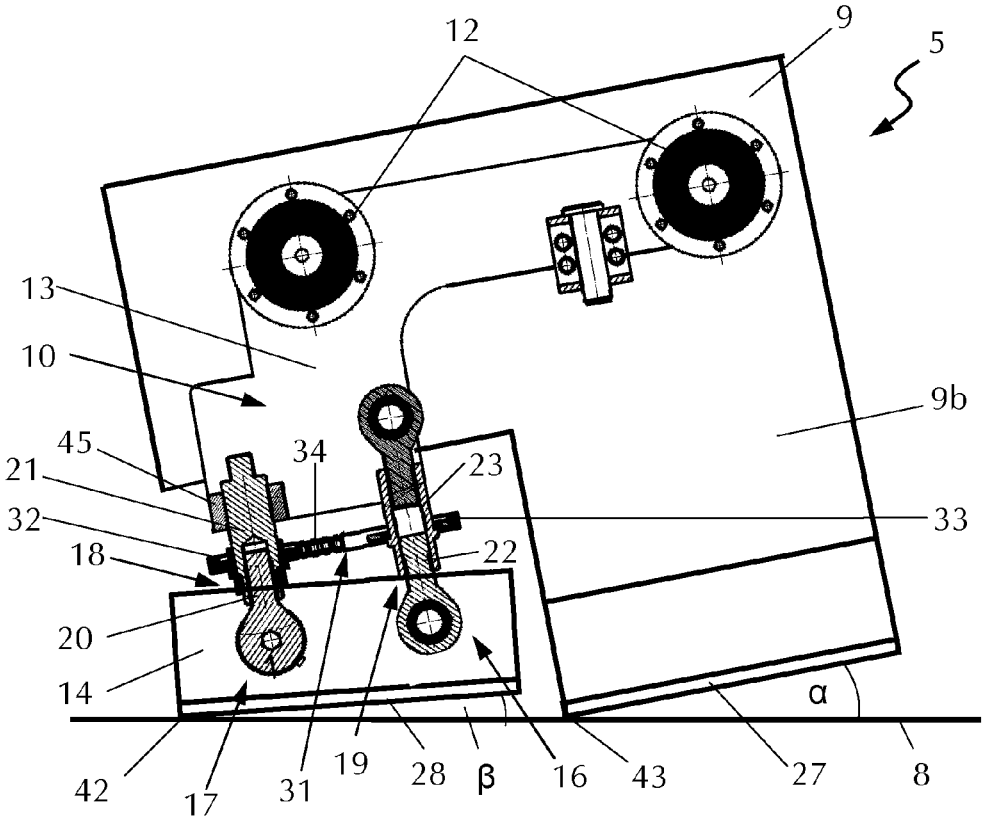
FIG. 7 is a cross-section through the paving screed plate shown in FIG. 2 showing a second adjustment of the setting angle of the basic screed plate and the extendable screed plate.

According to FIG. 7, however, it may also be desirable to provide the first base plate 28 with a second setting angle β, that differs from the first setting angle α of the second base plate 27. Here again, the clutch 35 is decoupled, so that rotation of the first spindle nut 21 will cause only the first adjusting member 17 to be changed in length, while the second adjusting member 16 remains unchanged in length. In the example illustrated in FIG. 7, the first adjusting member 17 is shortened in relation to the second adjusting member 16 such that the backward edges 42, 43 of the two base plates 27, 28 are at the same height while the second setting angle β of the first base plate 28 is smaller than the first setting angle a of the second base plate 27 on the basic screed plate 9.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A height adjusting device for an extendable screed plate for a road finisher, wherein a ground element of said extendable screed plate is disposed with two pairs of adjusting members for vertical adjustment on a top part of said extendable screed plate, wherein said adjusting members of each pair are interconnected via an actuator for concomitant actuation thereof, which adjusting members are configured as worm gears, wherein the worm gears of one pair are interconnected for the purpose of transferring a rotary movement via a transmission gear, that a worm gear of a pair is connected to said actuator, and that for at least one pair there is provided a releasable clutch, by means of which the connection between an adjusting member of said at least one pair and the associated transmission gear can be broken.

2. The height adjusting device according to claim 1, wherein each worm gear is in the form of screw-threaded spindle and a spindle nut, and that said transmission gear non-rotatably interconnects the spindle nuts of a pair.

3. The height adjusting device according to claim 2, wherein the transmission gear is configured as a power transmission, the spindle nuts of a pair are the shafts of the respective power transmission, the power transmission is in the form of a chain drive having two twin gearwheels, and that said gear wheels are disposed on said spindle nuts of a pair.

4. The height adjusting device according to claim 1, wherein for each pair there is provided a releasable clutch, by means of which the connection between an adjusting member of a pair with the associated transmission gear can be broken.

5. The height adjusting device according to claim 4, wherein said clutch is in the form of a force-locked clutch.

6. The height adjusting device according to claim 4, wherein said clutch is configured as a conical clutch between a spindle nut and the mating coaxial portion of the transmission gear, which directly communicates with said spindle nut.

7. The height adjusting device according to claim 6, wherein the conical clutch consists of a downwardly tapered truncated cone on said spindle nut and a corresponding bushing in a hub of the associated gearwheel and also a counter-nut on said spindle nut, on which the hub is mounted for axial displacement.

8. The height adjusting device according to claim 1, wherein said actuator is disposed on that worm gear of a pair which is present on that side of the extendable screed plate that is remote from said basic screed plate.

9. The height adjusting device according to claim 1, wherein said worm gears are disposed on said top part and said ground element of said extendable screed plate via ball-and-socket joints.

10. A road finisher comprising a height adjusting device according to claim 1.

* * * * *